US005476633A

United States Patent [19]

Sokolowski et al.

[11] Patent Number: 5,476,633

[45] Date of Patent: Dec. 19, 1995

[54] ULTRAHIGH-PURITY DIMENSIONALLY STABLE INVAR 36

[75] Inventors: Witold M. Sokolowski, Arcadia; Marc S. Lane, La Crescenta; Cheng H. Hsieh, Hacienda Heights; Timothy P. O'Donnell, Sierra Madre, all of Calif.

[73] Assignee: The United States of America as represented by the Administrator of the National Aeronautics and Space Administration, Washington, D.C.

[21] Appl. No.: 273,511

[22] Filed: Jul. 6, 1994

[51] Int. Cl.[6] ..... B22F 3/00

[52] U.S. Cl. ..... 419/57; 419/32; 419/28; 419/53; 419/54; 419/56; 419/48; 420/94; 75/228; 75/246

[58] Field of Search ..... 75/228, 246; 419/28, 419/32, 48, 53, 56, 54, 57; 420/94

[56] References Cited

U.S. PATENT DOCUMENTS

| | | | |
|---|---|---|---|
| 5,049,184 | 9/1991 | Harner et al. | 75/246 |
| 5,310,520 | 5/1994 | Jha et al. | 419/48 |

OTHER PUBLICATIONS

J. Marsh, Alloys of Iron and Nickel, vol. I McGraw–Hill Book Co., 1938, 135–183.

B. S. Lement, B. L. Averbach and M. Cohen, Trans. AMS 43, 1072–1097, 1951.

G. Z. Pupke, Phys. Chem. 207, 91, 1957.

C. W. Marshall, Proc. 21st, Natl. SAMPE Symp., Los Angeles, 1976.

Physics and Application of Invar Alloys, Honda Mem. Series on Materials Science, No. 3, Maruzen Co., Ltd., Tokyo, 1978 pp. 465–549.

M. A. Hunter, Low Expansion Alloys, Metals Handbook, American Society for Metals, Cleveland, Ohio, 1948, p. 601.

Iron–Nickel Alloys for Sealing Glasses and Ceramics, MIL–I–23011, U.S. Government Printing Office, Mar. 24, 1974.

T. P. O'Donnell and W. M. Rowe Processing and Thermal Expansion Performance of Three Invar Alloys, Intl. Joint Conf. on Thermophysical Properties, 8th Thermal Expansion Symposium Proceeding, Jun. 1981.

C. W. Marshall and R. E. Maringer, Dimensional Instability, Pergamon Press, N.Y. 1977.

A. D. White, Applied Optics 6, 1138, 1967.

D. Hills and J. L. Hall, Phys. Rev. Letters 64, 1697–1700 (1990).

J. B. Berthold and S. F. Jacobs, Ultraprecise Expansion Measurements of Several Low Expansion Material, Appl. Opt. 15, (1976).

D. E. Schwab, S. T. Jacobs and S. F. Johnston, Isothermal Dimension Instabilty of Invar, 29th Natl. SAMPE Symposium, pp. 169–184, Apr. 3–5 (1984).

J. W. Berthold, S. F. Jacobs and M. A. Norton, Dimensional Stability of Fused Silica, Invar and Several Ultra–Low Thermal Expans. Matls, Metrologia, 13, 9–16 (1977).

S. F. Jacobs, Dimensional Stability of Materials Useful in Optical Engineering, Optica Acta 33, 1377–1388 (1986).

J. M. Steele, D. A. Thompson, S. F. Jacobs and D. L. Bass, Temperature and Age Effects on Temporal Stability of Invar, SPIE Proc. V1752/10, Jul. 1992 San Diego.

S. F. Jacobs Variable Invariables—Dimensional Instability with Time and Temp. SPIE, C. R. Jul. 1992, San Diego, Calif.

A. I. Zakharow, B. V. Molotilow, L. V. Pastukhowa and N. A. Solov'yeva, Fiz. Metal, Metalloved 37, No. 2, 442–444 (1974).

*Primary Examiner*—Donald P. Walsh
*Assistant Examiner*—John N. Greaves
*Attorney, Agent, or Firm*—John H. Kusmiss

[57] ABSTRACT

An INVAR 36 material having long-term dimensional stability is produced by sintering a blend of powders of nickel and iron under pressure in an inert atmosphere to form an alloy containing less than 0.01 parts of carbon and less than 0.1 part aggregate and preferably 0.01 part individually of Mn, Si, P, S, and Al impurities. The sintered alloy is heat treated and slowly and uniformly cooled to form a material having a coefficient of thermal expansion of less than 1 ppm/°C. and a temporal stability of less than 1 ppm/year.

5 Claims, 2 Drawing Sheets

ULTRAHIGH-PURITY DIMENSIONALLY STABLE INVAR 36

ORIGIN OF THE INVENTION

The invention described herein was made in the performance of work under a NASA contract, and is subject to the provisions of Public Law 96-517 (35 USC 202) in which the Contractor has elected not to retain title.

TECHNICAL FIELD

This invention relates to alloys of iron and nickel and, more particularly, this invention relates to ultrahigh-purity, dimensionally stable INVAR 36 materials produced by powder metallurgy.

BACKGROUND OF THE INVENTION

Long term dimensional stability is required for support structures in many instruments having optical components focussed on distant objects. For example, imaging systems on future space flights such as the Saturn-bound Cassini spacecraft impose very strict requirements on the metering rods in the camera athermalizing system. The metering rods move optical elements relative to the camera to compensate for temperature variation in the system. The next generation systems represented by the camera to be used on the Cassini spacecraft use an imaging design having higher performance goals and which are very sensitive to dimensional errors. The metering rods must satisfy requirements for very low thermal expansivity and temporal stability more rigorous than ever required before.

Not only must the material meet the dimensional stability requirements, it must also be machineable and have mechanical strength required for its use. Alloys of iron and nickel such as Super Invar (Fe-Co-Ni) and INVAR 36 (Fe-36Ni) are known to have remarkably low coefficients of thermal expansion (CTE) near room temperature. This effect is believed due to the magnetic properties of the family of alloys. Though Super Invar has superb dimensional stability at room temperature, it is not suitable for use as supports in precision instruments due to its highly composition-dependent, irreversible phase transformation and temperature dependent temporal stability. It is also very difficult to fabricate.

INVAR 36 has more practical applications since it is easier to fabricate and has low CTE over a wide range of temperatures. The CTE of INVAR 36 has been reported to vary from −0.6 to +3.00 ppm/°C. in the temperature range of −70° to +100° C. With careful controls, it is commercially practical to produce INVAR 36 with a narrower range of CTE values, e.g. 0.8 to 1.6 ppm/°C. in the range of 30° to 100° C. However, the excellent thermal stability of INVAR 36 is not accompanied by isothermal temporal (long term) stability. Temporal instability values as high as +11.0 ppm/day at temperatures of 20° to 70° C. have been reported for Invars of varying composition and subjected to varying thermomechanical treatments.

Prior studies conducted on commercial Invar alloys indicate that impurities have a pronounced effect on the coefficient of thermal expansion. The thermal expansion is also affected by thermal and mechanical treatments. Temporal stability is known to be affected by test temperature, temperature changes, heat treatment and forming operations. The temporal stability decreases from room temperature to 60° C. in prior INVAR 36 materials. Heat treatment which is intended to stabilize and/or stress relieve INVAR 36 and accelerate the aging process may increase or decrease temporal stability. Studies show that commercial INVAR 36 expands with rates varying from 1.5 to 27 ppm/year.

However, conventional Invar alloy production does not have the necessary controls to produce high purity materials and, in fact, results in the introduction of impurities during alloying operations.

In conventional Invar alloy production, such as air or vacuum melting, antioxidants are added during the melting operation and refractory materials such as carbon-graphite can be introduced into the melt from the furnace lining during melting or from the lining of the ingot mold when the melt is poured. There is limited chemistry control of commercially produced ingots; chemical composition is only analyzed during the melt stage. A sample analysis is made during the melting stage. Adjustments to the alloy composition are made based on the analysis. There is no final analysis. The last analysis which is reported as the alloy composition may not represent the actual composition throughout the melt.

STATEMENT OF THE INVENTION

Ultrahigh-purity INVAR 36 is produced in accordance with the invention from very pure starting materials without the introduction of any impurities. The ultra high purity and processing conditions ensure a material with both low thermal expansion and very good temporal stability. The material is believed to be the most dimensionally stable INVAR 36 ever produced. Surprisingly, it has also been discovered that though INVAR 36 produced in accordance with the present invention has similar tensile properties when compared to conventional Invar 36, the INVAR 36 material of the invention exhibits better fatigue properties.

The INVAR 36 of the invention is produced by powder metallurgy. Accurate amounts of pure elemental iron and nickel powders are separately weighed to portions meeting the desired Fe/Ni atomic ratio. The powders are blended and pressed into billet form. The pressed material is sintered at a temperature of approximately 1370° C. (2500° F.) in an atmosphere of hydrogen ($H_2$) to form an ultra high purity INVAR 36 alloy. The composition of the alloy is Ni=36±0.8, Fe= remainder. The carbon content does not exceed 0.01 atomic percent and other impurities such as Mn, Si, P, S, and Al are present in an amount less than 0.1% and individually are present in an amount not to exceed 0.02 and preferably not more than 0.01 atomic percent of the alloy composition.

The powder metallurgy process utilized in the invention is a simple and relatively inexpensive manufacturing method. Composition control is practiced before the alloy is manufactured. The elemental iron and nickel powders are carefully analyzed prior to sintering. The alloy is prepared from precisely weighed and blended metals. The exact composition and purity are assured by the sintering method. The method insures high purity, cleanliness and precise chemistry control. Ultra high purity products are produced having reproducible high dimensional stability.

The heat treatment to stress relieve and stabilize the ultra high purity, low carbon content INVAR 36 is much shorter and simpler. Expansion change in prior materials was a carbon-dependent phenomenon. Sometimes many years of natural and artificial aging were necessary to stabilize INVAR 36 with high carbon and high impurities content. Also the aging at elevated temperature could result in a higher length drift rate for previously stabilized commercial

INVAR 36.

It also has been discovered in accordance with the invention that a new heat treatment with tightly controlled cooling rate increases microyield (resistance of material to deformation under applied loads). This heat treatment consists of:

1. Heating sintered ingot to above 1400° F. preferably 1450° F.±25° F. in inert or vacuum atmosphere. Holding the material at this temperature for at least 10 minutes, preferably 20–60 minutes for each inch of section thickness. Uniformly furnace cooling the material at a rate not to exceed 100° F./hour to a temperature of 300° F. The material can then be removed from the furnace and is cooled in air to room temperature.

2. Heating the material to a temperature of from 500°–700° F., preferably 600°±20° F., in a protective atmosphere. Holding the material at this temperature for at least ½ hour, preferably 1 hour and uniformly furnace cooling the material at a rate not to exceed 100° F./hr to 300° F. Air cooling to room temperature is then acceptable.

3. Heating the material to a temperature of from 150°–300° F., preferably 200°±5°, in a protective atmosphere and holding the material at this temperature for at least 24 hours, preferably 48 hours. Air cooling to room temperature is then acceptable.

This heat treatment does not decrease dimensional stability or tensile/compressive strength. It is designed to develop the optimum combination of dimensional stability, strength and microyield for the ultra pure HP INVAR 36 material of the invention.

In addition to optical mounting systems for spacecraft instruments, the ultra high purity INVAR 36 of the invention will find use in low-expansion mandrels, molds for use in production of low-expansion polymeric composite parts, stable optical mounts, support assemblies for commercial laser interferometers, cameras, watch industry, microelectronic packaging, stable mechanical support parts for precision devices such as computer disc drives, read/write mechanisms, profilometers, commercial satellite instrumentation such as imaging sensors and devices for surveying weather or land in the ultraviolet, infrared and visible wavelengths and other applications in areas of metrology, instrumentation and precision optical structures.

These and many other features and attendant advantages of the invention will become apparent as the invention becomes better understood by reference to the following detailed description when considered in conjunction with the accompanying drawings.

DETAILED DESCRIPTION OF THE INVENTION

The particles of iron and nickel are prepared to a specification such that the total carbon in the final product does not exceed 0.01 atomic percent and that total impurities of Mn, Si, P, S and Al do not exceed 0.10 atomic percent and preferably, each of these impurities does not exceed 0.02 atomic percent individually, and most preferably below 0.01 atomic percent.

Figure 1:
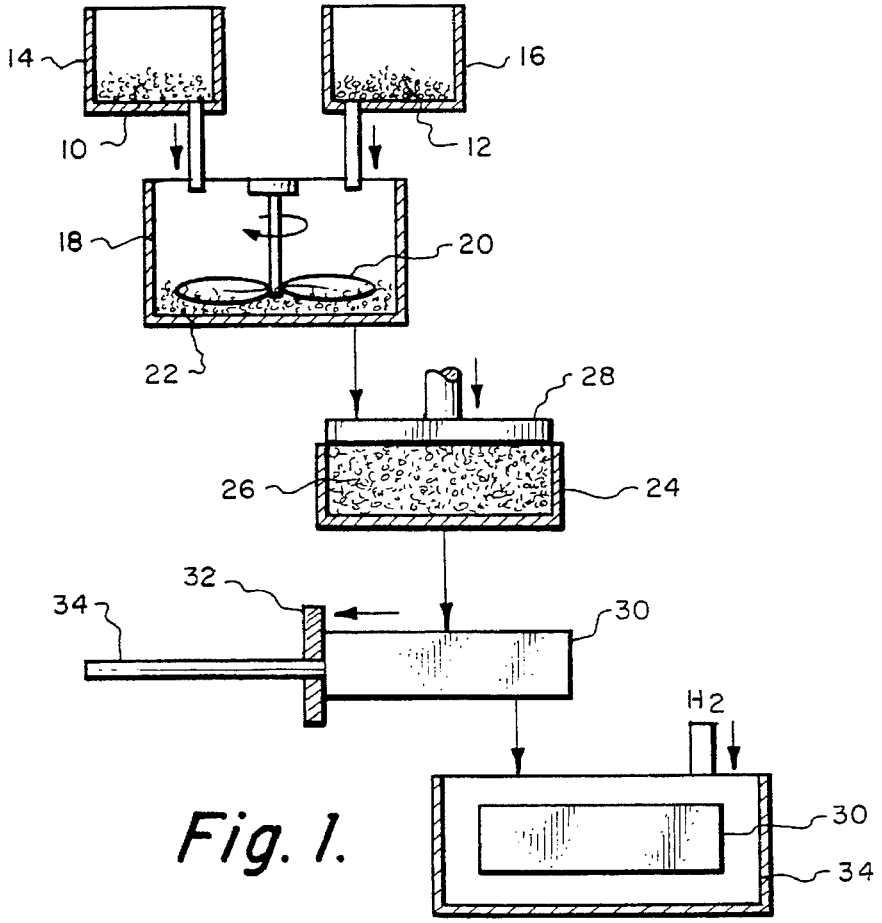
FIG. 1 is a schematic view of a system and process for producing ultra high purity iron-nickel alloys in accordance with the invention.

Referring now to FIG. 1, the dimensionally stable INVAR alloy of the invention is prepared from ultra pure particles or grains 10 of iron and particles or grains 12 of nickel. The ratio of iron to nickel particles is 36±0.8% nickel, the remainder being iron. The size of the particles is usually from 4 mm to 7 mm. The particles 10, 12 are weighed in separate containers 14, 16 and are then combined in a container 18 and blended by a mixer 20 to form a uniform mixture 22. The mixture 22 is poured into a cavity 24 in an ingot forming member 26 and pressed by means of an anvil 28 at an isostatic pressure of from 10 to 60 ksi. The particles sinter and flow together to form an ingot 30. The ingot can be drawn through a die 32 to form a rod 34. The alloy can be stress relieved by cold working during the drawing operation. The ingot 30 also can be stress relieved and stabilized by heat treatment in an inert atmosphere in an oven 34.

EXAMPLE 1

Accurate amounts of iron and nickel particles having a size of 4 to 7 mm in the exact proportion of 36 parts of nickel to 64 parts of iron were weighed, blended and pressed at an isostatic pressure of 35 kpsi, into a billet having dimensions of 10.16 cm×10.16 cm×137.16 cm (4"×4"×54"). The specified chemical composition of the INVAR 36 material is:

$$C \leqq 0.01\ Mn<0.01\ Si<0.01\ P<0.01\ S<0.01\ Al<0.01<Ni=36\pm0.8<Fe=\text{Remainder}.$$

The billet was sintered at 1370° C. for several days in a $H_2$ atmosphere. The billet was heat treated to increase strength and density under conditions to be described later. The billet was cut into two pieces. One piece was used to draw rods of 0.79 cm (0.312") diameter and 101.4 cm length (40") by extrusion. The other piece was hot hammered into 5.71 cm×26.03 cm×30.48–60.96 cm (2.25"×10.25"×12–24") slabs.

Chemical analysis of the rod produced in Example 1 was performed by different laboratories. Results follow in Table 1:

TABLE 1

| Element | Metals Technology | Atlas Testing | Specialty Alloy | JPL | Desirable Composition |
|---|---|---|---|---|---|
| C | 0.01 | 0.005 | 0.002 | 0.01 | <0.01 |
| Mn | 0.01 | 0.01 | <0.001 | <0.004 | <0.02 |
| Si | 0.04 | 0.04 | | <0.01 | <0.01 |
| P | 0.005 | 0.003 | <0.01 | 0.005 | <0.01 |
| S | 0.005 | 0.002 | | 0.003 | <0.01 |
| Cr | 0.01 | | <0.01 | | |
| Al | 0.01 | <0.01 | <0.001 | <0.01 | <0.02 |
| Se | 0.0001 | | <0.00001 | | |
| Ni | 36/24 | 36.0 | 36.0 | 36.8 | 36.0 ± 0.1 |
| Fe | REM | REM | REM | REM | REM |

The JPL results should be treated as the most reliable in light of the methods employed.

Specimens of the rod produced in Example 1 were heat treated before testing for dimensional stability. The heat treatments were intended to minimize the temporal length changes by a stress relieving operation and an accelerated aging cycle before finishing the rod to size and placing it in service.

EXAMPLE 2

Specimens from the ultra pure INVAR 36 rod produced in Example 1 were heat treated as follows:

1. Heat sample to 1450°±25° F. in inert/vacuum atmosphere, hold at this temperature 30 minutes for each inch of section thickness. Uniformly furnace cool at a rate not to exceed 200° F. per hour to 600° F. Then cool in air to room temperature.

2. Heat material to 600°±20° F. in protected atmosphere, hold at this temperature for 1 hour. Then cool in air to room temperature.

3. Heat material to 200°±5° F. in protected atmosphere and hold at this temperature for 48 hours. Then cool in air to room temperature.

EXAMPLE 3

Specimens were rough machined, annealed at a temperature of 1450°±25° F. in inert vacuum for 30 minutes, then final machined before performing the stress relief cycle (2) and aging cycle (3) described in Example 2.

EXAMPLE 4

The heat treatment cycle of Example 2 was repeated except that the aging cycle (3) was conducted for an additional 28.5 days.

EXAMPLE 5

Specimens were heat treated per steps 1 and 3 of the heat treatment described in Example 2.

EXAMPLE 6

Specimens were heat treated per steps 2 and 3 of the heat treatment described in Example 2.

The specimens were then tested for dimensional stability and CTE. Thermal hysteresis testing was also performed in order to determine the effect of thermal cycling.

The heat treatments increase temporal stability but sometimes CTE is sacrificed. In addition to CTE and temporal stability testing, thermal hysteresis testing was performed in order to find out the effect of thermal cycling.

The CTE/thermal hysteresis measurements were performed individually for each specimen within the temperature range of −50° C. to +50° C. in 25° C. increments and the overall CTE was determined. The temporal stability test was performed for at least 60 days at a temperature of 38° C. because most dimensional instabilities were expected to occur at elevated temperatures during the first two months of testing.

Measurement Methods

Two kinds of measurements were performed:

(1) Thermal expansion (CTE/thermal hysteresis—change of length with temperature), and (2) Temporal instability (change of length with time at constant temperature).

Both kinds of measurements rely on the same laser-interferometric principle. The sample is configured to form the spacer between two concave mirrors, thereby forming a confocal Fabry-Perot resonator. A tunable HeNe laser is optically aligned with this resonator, the cavity resonant frequency is observed, and the laser is then locked to the cavity resonant frequency. Lastly, a record is made of this laser frequency with respect to a stabilized reference laser. If at some later time the sample length changes due to time or temperature changes, then the cavity resonances change by an amount $\Delta\nu$. This frequency shift is measured by relocking the tunable laser to the new cavity resonant frequency and again comparing the laser frequency with respect to the reference laser. In this way an absolute measure of sample length change is obtained through the relation.

$$\frac{\Delta L}{L} = \frac{\Delta\nu}{\nu}$$

A shift $\Delta\nu$=474 MHz corresponds to 1 ppm.

In the experimental arrangement used for CTE/thermal hysteresis measurements, a sample was oriented vertical with optical axis in a vacuum better than 0.01 Torr. The $\Delta\nu$ and temperature data were recorded only after sample length stabilized to $\Delta L/L<0.001$ ppm/hour. CTE/thermal hysteresis measurements were performed individually for each specimen in the temperature range of −50° C. to +50° C., stopping every 25° C. to record $\Delta\nu$ and temperature. Plots were made of frequency shift vs. temperature, which were converted to $\Delta L/L$ vs. temperature. This also showed in detail how much each sample failed to return to its original length upon returning to its original temperature (referred to as thermal hysteresis).

In the arrangement used for temporal stability measurements, a massive copper sample holder had a capacity of 37 samples: 35 were supplied by JPL (including some other dimensionally stable, nonmagnetic candidate materials), and two were supplied by the University of Arizona—a copper sample (used for temperature stabilization) and an optically contacted Homosil sample used as a fused silica double check on the stability of the reference laser). Temporal stability testing was performed at 38° C. for over 11 weeks (80 days), after which the chamber temperature was dropped down to ambient (27.5° C.) and the specimen's length changes were monitored for another 6 weeks (43 days). The copper reference sample indicated the chamber temperature was held constant to ±0.015° C. The Homosil reference sample remained constant in length with ±0.01 ppm, indicating that the stable reference laser was indeed stable to $10^{-8}$ over the test duration. Each weekday a measurement was made, sequentially, of initial chamber temperature, each sample's resonant frequency change and final chamber temperature. These resonant frequency changes were plotted vs. time and later converted to $\Delta L/L$ vs. time.

Figure 2:
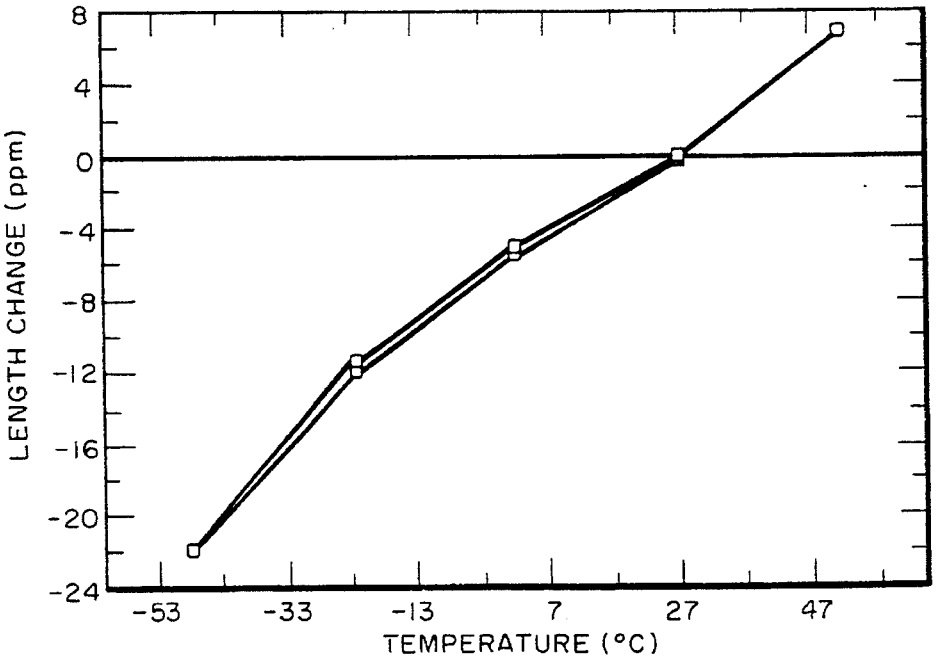
FIG. 2 is a curve of length change vs. temperature.
Figure 3:
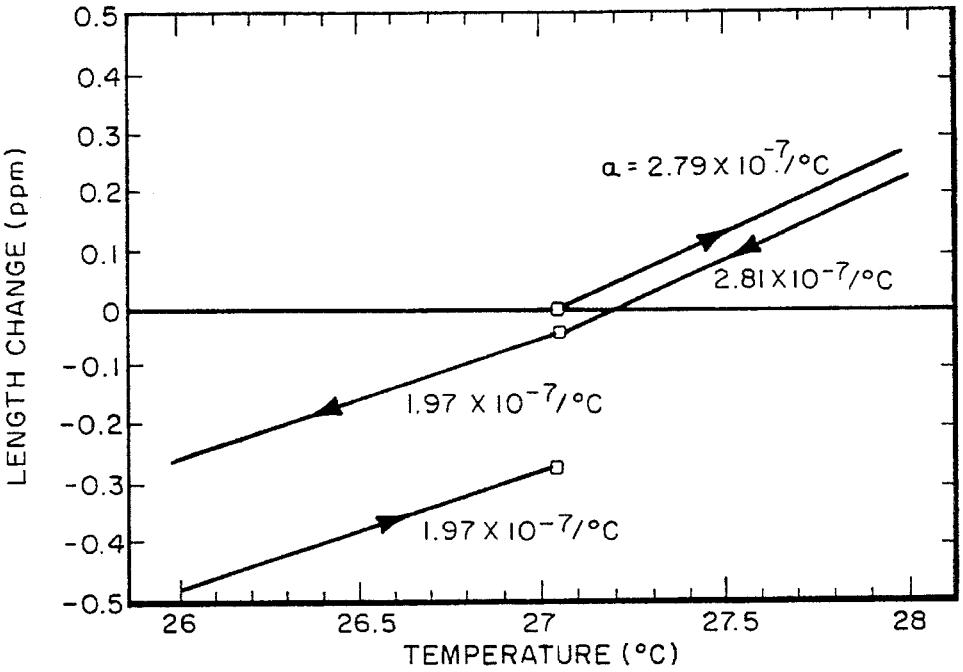
FIG. 3 is an expanded view of the curve of FIG. 2 near 27° C.

All CTE/thermal hysteresis data is briefly summarized in Table 3. Typical curve length change vs. temperature of the "as extruded" specimen of Example 1 is presented in FIGS. 2–3. A specimen diameter of 0.76 cm was used. In addition to overall CTE within the temperature range of −50° C. to +50° C., the CTE within the temperature range of 0° C. to 25° C. was also determined for each material and is shown in Table 3.

TABLE 3

CTE/THERMAL HYSTERESIS TEST RESULTS

| MATERIAL HP INVAR | CTE 0° C. TO 25° C. [ppm/°C.] | CTE −50° C. TO +50° C. [ppm/°C.] | HYSTERESIS −50° C. TO +50° C. [ppm/Cycle] |
|---|---|---|---|
| AS EXTRUDED | 0.20 | 0.29 | 0.28 |
| Example 2 | 0.71 | 0.80 | 1.05 |
| Example 3 | 0.76 | 0.85 | 0.12 |
| | 0.76 | 0.82 | 0.63 |

TABLE 3-continued

CTE/THERMAL HYSTERESIS TEST RESULTS

| MATERIAL HP INVAR | CTE 0° C. TO 25° C. [ppm/°C.] | CTE −50° C. TO +50° C. [ppm/°C.] | HYSTERESIS −50° C. TO +50° C. [ppm/Cycle] |
|---|---|---|---|
| Example 4 | 0.77 | 0.82 | 0.50 |
| | 0.74 | 0.81 | 2.70 |
| Example 5 | 0.70 | 0.81 | 2.70 |

The CTE test results indicated that among the HP INVAR 36 specimens measured, both the lowest CTE and the lowest thermal hysteresis was found for samples in the "as extruded" condition. All heat treatments, except Example 6 which was not tested for CTE, increased CTE of HP INVAR 36 (almost four times from 0.2 ppm/°C. to approximately 0.8 ppm/°C.). The extent of cold-work in HP INVAR 36 rods in "as extruded" condition was apparently sufficient to reduce the CTE markedly at these test temperatures. However, all HP INVAR 36 specimens ("as extruded" and heat treated) meet the thermal expansion requirements for metering rods of CTE<1 ppm/°C. Although the CTE results for all HP INVAR 36 specimens are very consistent, the thermal hysteresis results showed some specimen-to-specimen variation, especially for the heat treated specimens. Hysteresis values ranged from 0.12 to 2.70 ppm/cycle.

The temporal stability test was performed for a total of 81 days at a temperature of 38° C. Subsequently the temperature was dropped down to ambient (27.5° C.) and length changes were monitored for about 6 weeks. Due to cost considerations, all sample mirrors were held in place by gravity, rather than by optical contacting. However, the HP INVAR 36 specimens had small diameters (about 0.76 cm), which necessitated use of small and lightweight mirrors to form optical resonators. These small mirrors were susceptible to jumps and settlings caused by vibrations and perhaps dirt specks and/or electrostatic forces. Fortunately, the use of more than one specimen of each type made it possible to draw conclusions, although with varying certainty.

All temporal stability data is summarized in Table 4.

TABLE 4

TEMPORAL STABILITY TEST RESULTS

| | 38° 11 Weeks | | Ambient (27.5° C.) 6 Weeks | |
|---|---|---|---|---|
| Material | Rate (ppm/year) | Remarks | Rate (ppm/year) | Remarks |
| HP Invar | | | | |
| As Received | +2.4 | | 0 | |
| | −2.7 | *Questionable | −1.2 | *Questionable |
| Ex. 2 | −5.6 | *Questionable | −0.1 | *Questionable |
| | −2.2 | *Questionable | 0 | |
| | −1.4 | *Questionable | −1.2 | |
| Ex. 3 | −2.6 | *Questionable | −0.6 | |
| | −1.0 | | −0.6 | |
| | <0 | Noisy | −1.2 | |
| Ex. 4 | −1.5 | | −0.4 | *Questionable |
| | −0.6 | *Questionable | −0.6 | *Questionable |
| | No Data | | No Data | |
| Ex. 5 | −0.3 | | −1.2 | *Questionable |
| | −1.0 | *Questionable | −0.1 | |
| | −0.8 | | −3.0 | *Questionable |
| Ex. 6 | −1.1 | | −1.2 | |
| | −0.8 | | 0 | |

TABLE 4-continued

TEMPORAL STABILITY TEST RESULTS

| | 38° 11 Weeks | | Ambient (27.5° C.) 6 Weeks | |
|---|---|---|---|---|
| Material | Rate (ppm/year) | Remarks | Rate (ppm/year) | Remarks |
| | −0.8 | | −1.0 | |

*Questionable results within first 20 days of testing only.

Figure 4:
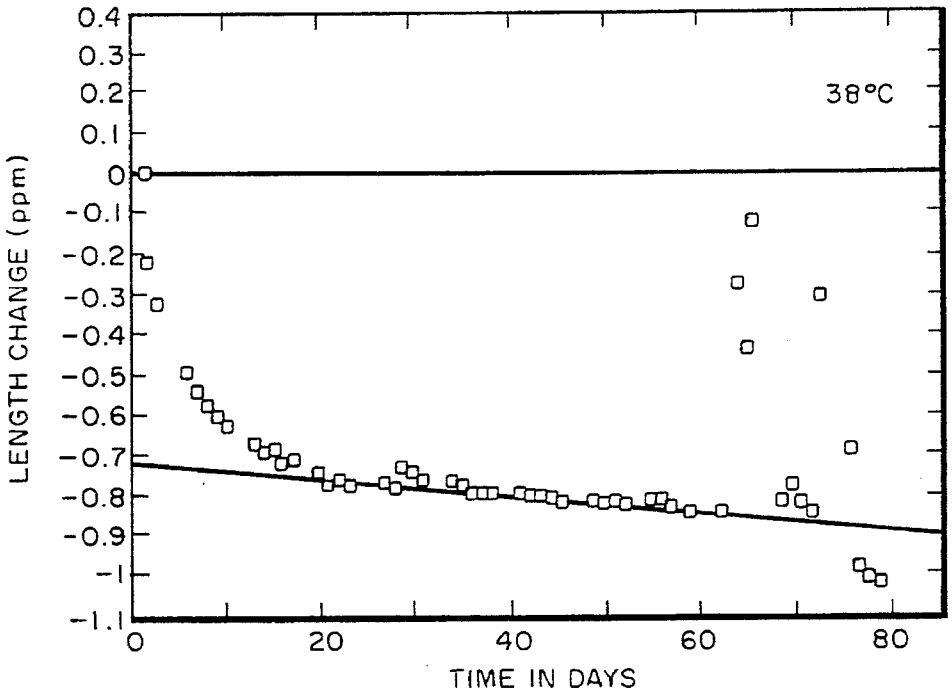
FIG. 4 is a curve of typical temporal stability of the material prepared in Example 4.

Typical temporal stability data for Example 4 is shown in FIG. 4. The length change rates represent the slope of the linear portion of each ΔL/L vs. days. Straight lines have been fitted to the data. A least-square analysis was not done because other uncertainties seemed far greater. In the judgment of the laboratory doing the testing all the nonlinear data should be considered questionable with the best possible conclusion drawn from the linear segment. It was not clear how to interpret and qualify the data in cases where the length changed in a nonlinear manner. The cause of the nonlinearity could have been material relaxation or it could have been something like a speck of dirt or electrostatic charge repulsion. The temporal stability was analyzed by the inventors by fitting exponential lines to the data.

Almost all specimens were shrinking no faster than 1 ppm/year. The samples from the heat treatment of Example 2 gave the most nonlinear results at 38° C., while the samples from Example 6 provided the confident straight line data. The HP INVAR 36 in "as extruded" condition was the most unstable at 38° C. for eleven weeks; however, upon dropping to 27.5° C. for six weeks, it slowed to about zero ppm/year. These eleven weeks at 38° C. could be a good stabilizing treatment for HP INVAR 36 to be used at ambient temperature. However, since the temporal stabilities of two specimens were so different, there are residual concerns. The temperature change from 38° C. to 27.5° C. did not trigger any drastic new length drift rate for the heat-treated HP INVAR specimens. In general, it improved dimensional stability and provided more confident straight line data for three-step heat treatments of Examples 2 and 3, while a simple two-step stress relief/stabilizing heat treatment of Example 6 was not much affected and gave straight line data and good temporal stability at both temperatures.

The dimensional stability test results confirm that HP INVAR 36 made by powder metallurgy is an exceptionally dimensionally stable material. It was proven that high purity (carbon content<0.01% and other impurities content<0.10%) ensured both low thermal expansion and excellent temporal stability. A CTE<1 ppm/°C. along with a temporal stability of 1 ppm/year were achieved together. These dimensional stability characteristics have never been reported before for any Invar material. Actually, all HP INVAR 36 specimens with or without the heat treatments were shrinking very slightly at 27.5° C. and at 38° C. as well during temporal stability testing. It could be interpreted that this contraction was possible due to the relief of internal stresses left after thermomechanical processes (e.g., extrusion/heat treatments.) It appears that powder metallurgy made HP INVAR 36 behave in part similarly to conventionally made INVAR 36, especially in the thermal expansivity area. The lowest CTE found in "as extruded" condition indicates that cold working and other thermomechanical processes increase thermal stability of HP INVAR 36 similar to commercial Invar 36. Also, all stabilization heat treatments with high-temperature annealing (at 788° C.)

increased the CTE of HP INVAR 36. However, all HP INVAR 36 specimens ("as extruded" and heat treated) had a low CTE of<1 ppm/°C., which that suggests the high purity of HP INVAR 36 ensured CTE low enough for all specimens to meet thermal stability requirements.

Almost all specimens were shrinking no faster than 1 ppm/year at both temperatures, which is a noteworthy achievement and meets temporal stability requirements for metering rods. Also, the temperature changes from 38° C. to 27.5° C., unlike for commercial Invars, did not trigger any drastic new length drift rate for the heat-treated HP INVAR 36 specimens. Furthermore, all heat treatments resulted in the meeting of both thermal and temporal stability requirements.

The simple low-temperature, two-step stress relief/stabilizing heat treatment (Example 6) did not result in any significant stability variation with temperature change and provided more confident linear, temporal stability data at both temperatures.

All the 27.5° C. data showed excellent temporal stability, but there is no way to be sure what would have happened without the previous eleven weeks of 38° C. exposure. One cannot escape eleven weeks at 38° C. as part of the heat treatment. Then, the assured conclusion for the lowest CTE, lowest hysteresis and the best temporal stability at ambient temperature (27.5° C.) could be HP INVAR 36 in "as extruded" condition with 11 weeks stabilization treatment at 38° C. However, this HP INVAR 36 was very unstable (high length change rate) at 38° C. and the temporal stabilities of two specimens at 27.5° C. were not consistent, which may cause some concerns. Longer time of aging treatment at 38° C. may be needed for complete stabilization and very good temporal stability of INVAR 36 "as extruded" at ambient temperature.

The superpure INVAR 36 of the invention is believed to be the most dimensionally stable Invar 36 material ever produced. High purity and cleanliness of HP INVAR 36, i.e. carbon content<0.01% and other impurities<0.10%, ensured both low thermal expansion and very good temporal stability. Almost all HP INVAR 36 specimens were exceedingly stable with time (<1 ppm/year) and temperature (<1 ppm/°C.). Almost all specimens were shrinking more slowly than 1 ppm/year. A temperature change from 38° C. to 27.5° C. did not trigger any drastic new length drift rate except for the "as extruded" condition.

The three-step heat treatment of Example 3 appears to be the best among the three-step heat-treated HP INVAR 36 specimens with low thermal hysteresis, low thermal expansion and good temporal stability as well. The heat treatment did not decrease dimensional stability or tensile compressive strength. It developed the optimum combination of dimensional stability, strength and microyield for the ultrapure INVAR 36 material of the invention.

The simple two-step heat treatment of Example 6 did not result in any significant stability variation with temperature change and provided more confident linear temporal stability data at both temperatures. HP INVAR 36 in "as extruded" condition with 11 weeks or longer stabilization treatment at 38° C. could have the lowest CTE, thermal hysteresis and good temporal stability at 27.5° C.

Mechanical test results indicate similar tensile properties but a much higher fatigue endurance limit when compared with conventional Invar 36. Better fatigue properties are an added benefit of the invention in addition to the dimensional stability.

It is to be realized that only preferred embodiments of the invention have been described and that numerous substitutions, modifications and alterations are permissible without departing from the spirit and scope of the invention as defined in the following claims.

We claim:

1. A method of forming an alloy of iron and nickel having long term dimensional stability comprising the steps of:

blending powders of nickel and iron in the proportions of 36 parts of Ni±1.0 parts, remainder Fe, having an impurities content below 1 part and containing less than 0.01 parts of carbon to form an intimate mixture;

sintering the mixture in a hydrogen atmosphere under pressure to form an alloy in which the total carbon in the alloy does not exceed 0.01 parts and Mn, Si, P, S and Al impurities do not individually and collectively exceed 0.01 parts;

heat treating the alloy to a first temperature of 1375° F. to 1475° F. in an inert atmosphere and holding the alloy at the first temperature for 10 to 60 minutes for each inch of section thickness of the alloy;

then uniformly furnace cooling the alloy at a rate not to exceed 100° F./hour to a temperature of about 300° F. and then air cooling the alloy to room temperature;

then heating the alloy to a second temperature of from 500° F. to 700° F. in a protective atmosphere and holding the alloy at the second temperature for at least one-half hour and then furnace cooling the alloy at a rate not to exceed 100° F. per hour to 300° F. and then air cooling the alloy to room temperature;

then heating the alloy to a third temperature of from 150° F. to 300° F. in a protective atmosphere, holding the alloy at the third temperature for at least 24 hours and air cooling the alloy to room temperature; and recovering an alloy having a coefficient of thermal expansion at −50° C. to 50° C. of less than 1 ppm/°C./year and a temporal stability of less than 1 ppm/year at 27.5° C.

2. A method according to claim 1 in which the alloy is subject to thermomechanical cold working before said heat treatment of the alloy.

3. A method according to claim 2 in which the cold working is conducted by drawing the alloy into a rod.

4. A method according to claim 1 in which nickel is present in 36±0.8 parts.

5. An alloy produced according to the method of claim 1.

* * * * *